US005230200A

United States Patent [19]

Douglas et al.

[11] Patent Number: 5,230,200

[45] Date of Patent: Jul. 27, 1993

[54] WALLBOARD AND METHOD OF JOINING WALLBOARDS

[76] Inventors: Waymon J. Douglas, 2905 Nakomi Dr., Lexington, Ky. 40503; Wilburn C. Douglas, 114 Carolyn Dr., Nicholasville, Ky. 40356

[21] Appl. No.: 478,933

[22] Filed: Feb. 12, 1990

Related U.S. Application Data

[63] Continuation-in-part of Ser. No. 264,853, Oct. 31, 1988, abandoned.

[51] Int. Cl.[5] ..... E04B 1/00

[52] U.S. Cl. ..... 52/746; 52/307.9; 52/417; 156/71; 156/275.3

[58] Field of Search ..... 52/416, 417, 419, 420, 52/744, 309, 746; 428/703, 49, 50; 156/71, 275.3

[56] References Cited

U.S. PATENT DOCUMENTS

| | | | |
|---|---|---|---|
| 1,526,108 | 2/1925 | Adams | 52/417 X |
| 3,180,058 | 4/1965 | Tillisch et al. | 428/703 X |
| 3,385,019 | 5/1968 | Frank | 428/703 X |
| 3,435,582 | 4/1969 | Disney et al. | 52/417 X |
| 3,576,091 | 4/1971 | Shull, Jr. et al. | 428/703 X |
| 3,708,935 | 1/1973 | Kossuth et al. | 52/416 |
| 4,238,542 | 12/1980 | Burley | 428/49 X |
| 4,735,027 | 4/1988 | Evans et al. | 52/410 |

FOREIGN PATENT DOCUMENTS

| | | | |
|---|---|---|---|
| 1048869 | 2/1979 | Canada | 52/601 |

*Primary Examiner*—Carl D. Friedman
*Assistant Examiner*—Lan M. Mai
*Attorney, Agent, or Firm*—Frank C. Leach, Jr.

[57] ABSTRACT

A wallboard is formed with each of its abutting top and bottom surfaces extending from its rear surface substantially perpendicular thereto for less than 50%, preferably 37½%, of the distance between the rear surface and the front surface. The wallboard has a convex curved surface extending from the termination of the abutting top or bottom surface to the front surface. When the abutting surfaces of two wallboards are disposed in abutting relation, a deep fill recess is formed between the curved surfaces of the two adjacent wallboards. The recess is filled with a sealing compound having a greater compression strength than the compression strength of each of the adjacent wallboards so that any compression of the wallboards is absorbed by the wallboards and not the sealing compound whereby no tape is required at the wallboard joint and no ridging occurs.

22 Claims, 1 Drawing Sheet

WALLBOARD AND METHOD OF JOINING WALLBOARDS

This is a continuation-in-part of U.S. application Ser. No. 07/264,853, filed Oct. 31, 1988, now abandoned.

This invention relates to a wallboard and a method of forming a joint between two adjacent wallboards without tape and, more particularly, to a wallboard having specially designed top and bottom surfaces and a method of forming a joint between two such adjacent wallboards.

When forming walls and ceiling of a room of a building with gypsum wallboard, wallboards are attached to vertically extending studs to form each wall of the room and to horizontally extending ceiling joists to form the ceiling of the room. It is necessary to utilize finish means to conceal the wallboard joint between each two adjacent wallboards to enable formation of a substantially smooth wall or a substantially smooth ceiling.

The most common method of presently finishing a wallboard joint to conceal the joint is to utilize a tape and a joint compound capable of having the tape applied thereto within a slight recess formed in the adjacent wallboards in their front surfaces and extending from the abutting surfaces of the adjacent wallboards. A first coating of the joint compound is applied at the wallboard joint to fill the slight recess within the two adjacent wallboards and a tape is then applied. The tape is wiped smooth with suitable means such as a wide knife, for example, to remove any excess joint compound. When the joint compound cures to become dry and this requires at least twenty-four hours in most situations, the joint compound shrinks so as to not completely fill the recess in the adjacent wallboards. As a result, the first coat of the joint compound and the tape are sanded smooth, and a second coat of the joint compound is applied over the first coat of the joint compound and the tape. After the second coat of the joint compound dries and is sanded smooth, a third coat of the joint compound is applied. After the third coat of the joint compound dries, it is sanded smooth and is ready to be painted. This entire operation takes at least seven days.

After the building is completed, the studs and the joists begin to dry out since they are no longer exposed to the atmospheric elements. As a result, the length of each of the studs and the joists shrinks to cause compression of the wallboards attached thereto so that adjacent wallboards press against each other. When this occurs, the tape, which is glued to each of the adjacent wallboards at each joint, can only bulge outwardly to form a ridge since the joint compound and the tape have less resistance to compression than each of the adjacent wallboards.

Ridging is not noticeable until at least several months after installation of the wallboards. Since this occurs a period of time after construction is completed and can cost as much as the original wallboard installation, there is a substantial expense for the building owner to repair the ridging.

Various types of wallboards and wallboard joints are disclosed in U.S. Pat. Nos. 1,526,108 to Adams, 1,559,134 to Utzman, 1,663,219 to Schumacher, 2,078,049 to Benedict, 2,198,316 to Richardson, 3,066,450 to Raffaelli, 3,241,276 to Vance et al, 3,385,019 to Frank, 3,435,582 to Disney et al, 3,444,657 to Swanson, 3,576,091 to Shull, Jr. et al, 4,584,224 to Schneller, and Re. 26,382 to Tillisch et al. The aforesaid patents suggest various ways of forming a wallboard joint. None of the aforesaid patents is capable of solving the ridging problem.

For example, the aforesaid Disney et al patent discusses solving the ridging problem of a wallboard joint, but this is not describing the ridging problem created by a taped joint. The aforesaid Disney et al patent utilizes a tape and requires a plurality of coats of adhesive to be applied. There is no recognition in the aforesaid Disney et al patent that compression of the adjacent wallboards causes rupture of the joint compound whereby the tape bulges.

Even if the recess formed by the curved surfaces in the aforesaid Disney et al patent were to have a compound with a compression strength greater than the compression strength of the wallboards, it still would not solve the ridging problem. This is because the width of the recess between the adjacent wallboards is specifically limited to limit the volume of compound between the adjacent wallboards and a tape is utilized. There also is still required a plurality of coats of adhesive after the tape is applied so that the time consuming task of concealing the wallboard joint still exists along with the ridging problem.

The aforesaid Shull, Jr. et al patent discloses a wallboard joint in which a paper joint tape may be used in a slight recess, which is known as the taper area, at the wallboard joint with a thermoplastic adhesive. Instead of using the paper joint tape, an open mesh fiber cloth made from glass fiber may be employed. With either the paper joint tape or the open mesh fiber cloth, the thermoplastic adhesive has a width less than the taper area. A thin layer of adhesive, which is slightly wider than the taper area, is applied over the thermoplastic adhesive and the paper joint tape or the open mesh fiber cloth. The aforesaid Shull, Jr. et al patent also can form the wallboard joint without the paper joint tape or the open mesh fiber cloth with the thermoplastic adhesive deposited over the entire taper area.

Accordingly, the aforesaid Shull, Jr. et al patent does not teach that it is necessary to omit the paper joint tape to avoid ridging but believes that it is immaterial as to whether the paper joint tape or any joint reinforcing material is employed. The aforesaid Shull, Jr. et al patent also has no suggestion that the size of the slight recess between the adjacent wallboards should be increased to provide a larger volume for a sealing compound; instead, when used with a reinforcing material, the aforesaid Shull, Jr. et al patent does not use all of the relatively small volume of the taper area for the thermoplastic adhesive.

The aforesaid Shull, Jr. et al patent states that its wallboard joint system decreases the tendency of the joint to bead, which appears as a line or ridge along the joint; this is referring to ridging. The aforesaid Shull, Jr. et al patent sets forth that there are differences of opinion within the industry relative to the cause of ridging but that it is generally agreed that moisture is one of the most significant factors causing this condition. The aforesaid Shull, Jr. et al patent believes that the water-resistant thermoplastic adhesive greatly diminishes the amount of water that can be absorbed by the wallboard in the joint area to reduce the possibility of beading. However, this is not a recognition that compression of the adjacent wallboards, due to shrinkage of the studs or joists on which the wallboards are mounted through the loss of moisture from the studs or joists, produces ridging. It is not the amount of moisture in the wallboard that produces ridging as the aforesaid Shull, Jr. et al patent states, but the amount of moisture in the studs or joists.

Furthermore, the aforesaid Shull, Jr. et al patent seems to contemplate having only the same strength at the wallboard joint with the thermoplastic adhesive as when using a paper joint tape and a joint compound of an adhesive. Because the aforesaid Shull, Jr. et al patent deems it necessary for the thermoplastic adhesive to fill the taper area only if the paper joint tape or the open mesh fiber cloth is not used, there is no recognition of the need to have an increased volume of the compound. Therefore, even if the aforesaid Shull, Jr. et al patent employed the thermoplastic adhesive with the open mesh fiber cloth, it still would not solve the ridging problem. This is because of the lack of a sufficient volume of the compound between the adjacent wallboards.

The present invention satisfactorily solves the ridging problem at a wallboard joint through not using a tape, which bulges to produce ridging, and through preventing compression of the wallboards, created by shrinking of the studs and the ceiling joists, from causing a sealing compound at the joint to fracture. This is accomplished through employing wallboards in which abutting top and bottom surfaces of adjacent wallboards extend from the rear surface of each of the wallboards for less than one-half of the distance between the rear surface and the front surface of the wallboard. The present invention employs a relatively deep recess between the two adjacent wallboards beyond the termination of the abutting surfaces and has a sealing compound in the recess with a greater resistance to compression than either of the adjacent wallboards. This causes the compression of the wallboards, created by the shrinking of the lengths of the studs or joints to which the wallboards are attached, to be absorbed in the wallboards and not the sealing compound.

In addition to avoiding the ridging problem, the present invention also significantly reduces the total time required to complete erection of the walls and the ceiling of a room of a building. This is because the sealing compound cures in less than two hours and does not shrink to any extent. Thus, only a single thin coat of a joint compound is applied over the sealing compound to provide a surface for painting. Therefore, the long waiting time for curing of the three coatings of the joint compound is avoided with the present invention.

Canadian patent 1048869 discloses various wallboard shapes. One shape has a flat tapered face sloping downwardly at an angle with a flat horizontal front face and then continuing smoothly along a rounded convex curve into a vertical edge face. However, the curve does not extend to the flat front face since the flat tapered face extends from the front face; this will produce a visible line under lighted conditions when there is compression of the adjacent wallboards due to shrinkage of the studs or joints. Therefore, this wallboard shape would produce the same undesired aesthetics as ridging. The present invention avoids this problem through having each wallboard formed with a connecting surface, which extends between an abutting surface of the wallboard an its front surface, curved at least adjacent its intersection with the front surface.

An object of this invention is to form a wallboard joint without a tape.

Another object of this invention is to erect walls and ceilings of wallboard in a relatively shorter period of time.

A further object of this invention is to form a wallboard so that ridging at a wallboard joint is eliminated.

Other objects of this invention will be readily perceived from the following description, claims, and drawings.

This invention relates to a method of forming a wallboard joint finished without tape between two wallboards including forming each of the two wallboards with substantially parallel front and rear surfaces and forming each of two substantially parallel surfaces of each of the two wallboards substantially perpendicular to a rear surface of the wallboard with each of the two substantially parallel surfaces extending from the rear surface less than one-half of the distance from the rear surface of each of the two wallboards to its front surface. A connecting surface is formed from an end of each of the two substantially parallel surfaces, remote from the rear surface, of each of the two wallboards to the front surface with the connecting surface being curved at least adjacent the front surface of each of the two wallboards. One of the two substantially parallel surfaces of each of the two wallboards is disposed in abutting relation with each other so that the two wallboards are adjacent wallboards having a deep fill recess formed between the connecting surfaces of the adjacent wallboards. Then, a sealing compound, which has a greater compression strength than the compression strength of each of the adjacent wallboards, is deposited in the deep fill recess formed between the connecting surfaces of the adjacent wallboards so that the sealing compound fills the deep fill recess.

This invention also relates to a wallboard joint formed without tape including a pair of adjacent wallboards. Each of the adjacent wallboards includes a front surface, a rear surface substantially parallel to the front surface, a pair of substantially parallel surfaces extending from the rear surface substantially perpendicular thereto for less than one-half of the distance between the front surface and the rear surface, and a connecting surface extending from the termination of each of the substantially parallel surfaces to the front surface with each of the connecting surfaces being curved convexly at least adjacent the intersection with the front surface. One of the pair of substantially parallel surfaces of one of the adjacent wallboards abuts one of the pair of substantially parallel surfaces of the other of the adjacent wallboards. There is cooperation between one of the connecting surfaces of each of the adjacent wallboards to form a deep fill recess therebetween. The deep fill recess is filled by a sealing compound having a greater compression strength than the compression strength of either of the adjacent wallboards.

This invention further relates to a wallboard for use in forming a wallboard joint finished without tape including a front surface, a rear surface substantially parallel to the front surface, and a pair of parallel surfaces extending from the rear surface substantially perpendicular thereto for less than one-half of the distance between the front surface and the rear surface. A connecting surface extends from the termination of each of the substantially parallel surfaces to the front surface with each of the connecting surfaces being curved convexly at least adjacent its intersection with the front surface.

The attached drawings illustrate a preferred embodiment of the invention, in which.

Figure 1:
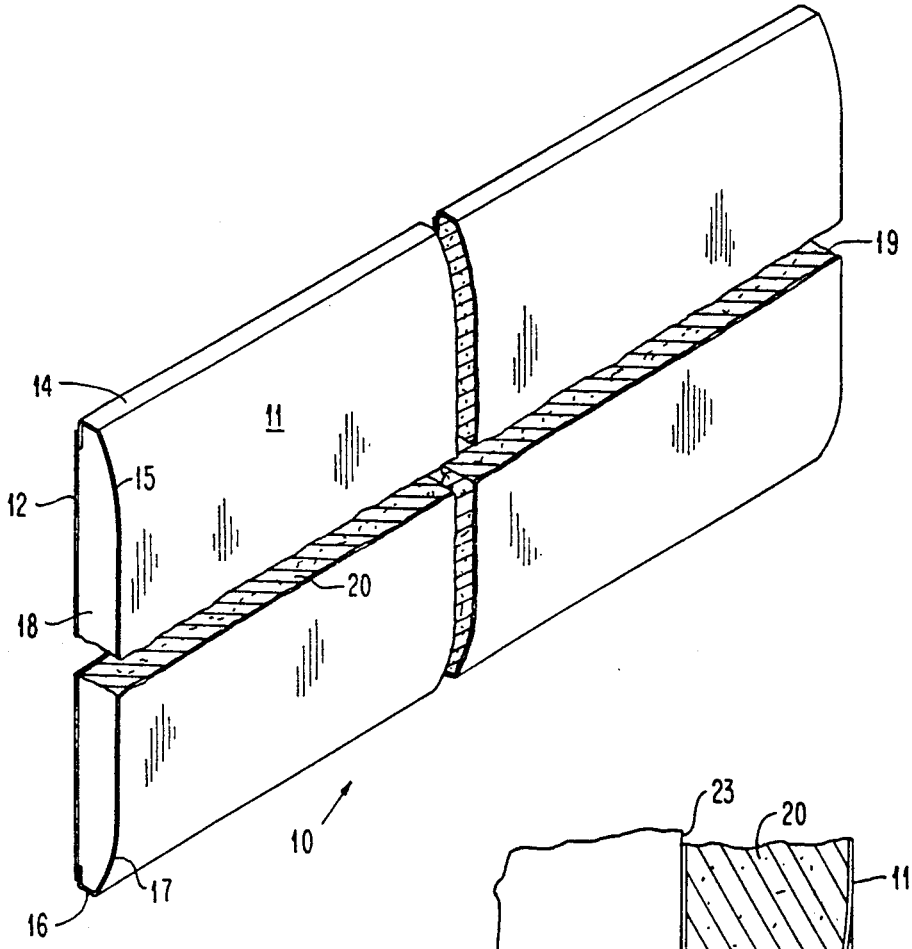
FIG. 1 is a perspective view of a wallboard of the present invention for use in practicing the method of the present invention.

Referring to the drawings and particularly FIG. 1, there is shown a wallboard 10, which is formed of gypsum, for example. The wallboard 10 includes a front surface 11 capable of having paint applied thereto and a rear surface 12, which is substantially parallel to the front surface 11. The wallboard 10 has a top surface 14 extending substantially perpendicular from the rear surface 12 for less than one-half the distance between the front surface 11 and the rear surface 12. A connecting surface 15, which is preferably a convex curve throughout its entire length, extends from the termination of the top surface 14 to the front surface 11.

The wallboard 10 has a bottom surface 16 extending substantially perpendicular from the rear surface 12 for less than one-half the distance between the front surface 11 and the rear surface 12 and for the same distance as the top surface 14 extends. The bottom surface 16, which is substantially parallel to the top surface 14, has a surface 17 connecting its terminal end to the front surface 11. The connecting surface 17 is preferably a convex curve for its entire length.

The distance between the front surface 11 and the rear surface 12 of the wallboard 10 is ½" with each of the top surface 14 and the bottom surface 16 preferably extending 3/16" from the rear surface 12. Thus, each of the top surface 14 and the bottom surface 16 of the wallboard 10 preferably extends for 37½% of the distance between the front surface 11 and the rear surface 12 of the wallboard 10.

The wallboard 10 has side surfaces 18 and 19, which are substantially parallel to each other. The side surfaces 18 and 19 are substantially perpendicular to the front surface 11, the rear surface 12, the top surface 14, and the bottom surface 16.

The wallboard 10 includes a core 20 of gypsum, for example, covered with a finish paper 21 (see FIG. 3) on its front, top, and bottom to define the front surface 11, the top surface 14, and the bottom surface 16 (see FIG. 1) of the wallboard 10. The finish paper 21 (see FIG. 3) may have paint applied to its portion forming the front surface 11. The rear surface 12 of the wallboard 10 includes a paper 22 overlying most of the rear of the core 20 and the ends of the finish paper 21 extending slightly over the rear of the core 20. There is no paper on either of the side surfaces 18 (see FIG. 1) and 19.

Each of the wallboards 10 extends for four feet between the top surface 14 and the bottom surface 16. The length of each of the wallboards 10 can vary up to sixteen feet. Thus, when forming a room with an eight foot ceiling, for example, two of the wallboards 10 are utilized.

Figure 2:
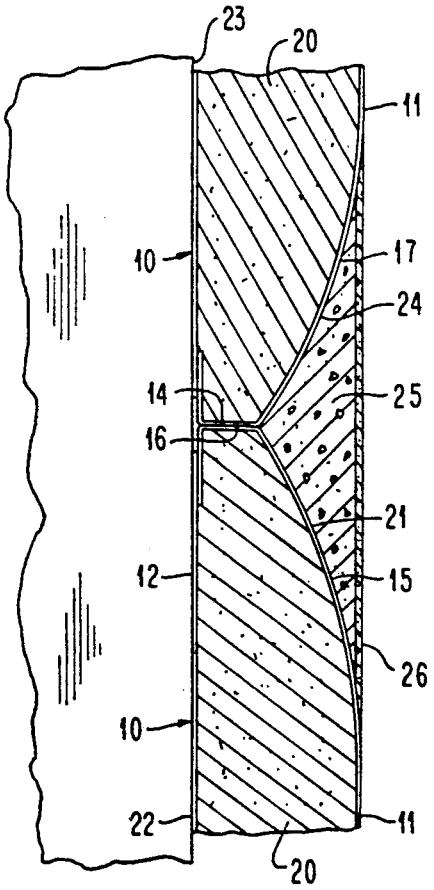
FIG. 2 is a fragmentary sectional view of two adjacent wallboards having a wallboard joint formed by the method of the present invention.

As shown in FIG. 2, one of the wallboards 10 is disposed above the other of the wallboards 10. Each of the wallboards 10 is attached to a plurality of vertical studs 23 (one shown) by suitable means, which preferably are screws.

When one of the wallboards 10 is disposed on top of another of the wallboards 10 as shown in FIG. 2, the top surface 14 of the lower of the wallboards 10 and the bottom surface 16 of the upper of the wallboards 10 abut each other to form a wallboard joint therebetween. When two of the wallboards 10 abut each other as shown in FIG. 2, a deep fill recess 24 is formed between the connecting surfaces 15 and 17 of the adjacent wallboards 10.

A sealing compound 25 initially fills the deep fill recess 24. The sealing compound 25 is formed of a material having a greater compression strength than the compression strength of either of the abutting wallboards 10. One suitable example of the sealing compound 25 is a mixture of chopped fiberglass and a fast setting cement. One suitable example of the fast setting cement is sold under the trade name Sta-Smooth by Gold Bond Building Products Division of National Gypsum Co., Charlotte, N.C. The chopped fiberglass is preferably strands of one-half inch length purchased from Gold Bond Building Products Division of National Gypsum Co., Charlotte, N.C.

The amount of chopped fiberglass is selected to produce a mixture having a workable consistency. The preferred mixture is made by disposing twelve to thirteen pints of water in a five gallon container to which is added chopped fiberglass. The chopped fiberglass is preferably strands having a length of one-half inch, weighs 55.95 grams (about two ounces), and comprises approximately two-thirds of a cup (5⅓ fluid ounces) by volume.

The water and the fiberglass are stirred with an electric mixer until the fiberglass strands are in suspension in the water. This requires about thirty seconds.

Then, the fast setting cement, which is a powder including plaster of Paris, talc, mica, and quartz that is sold under the trade name Sta-Smooth, is added in small quantities to the mixture. The electric mixer continues mixing as the powder is added until the mixture is at a desired workable consistency. This workable consistency is such that the mixture will not flow from a flat surface and is like a paste. This produces slightly less than five gallons of the mixture.

As used in the claims, the term "fast setting cement" refers to any material that can be mixed with the fiberglass and will harden in a relatively short period of time to produce the sealing compound 25 with a compression strength greater than the compression strength of either of the abutting wallboards 10.

After the sealing compound 25 cures and this requires only 1 to 1½ hours, a very thin coating 26 of a joint compound is applied to the cured sealing compound 25. This enables a smooth finish to be produced by an installer sanding it so as to have a surface to which paint may be applied. One suitable example of the joint compound is sold by Gold Bond Building Products Division of National Gypsum Co., Charlotte, N.C. under the trade name Gold Bond. The coating 26 has a thickness of 1/64" to 1/32".

Figure 3:
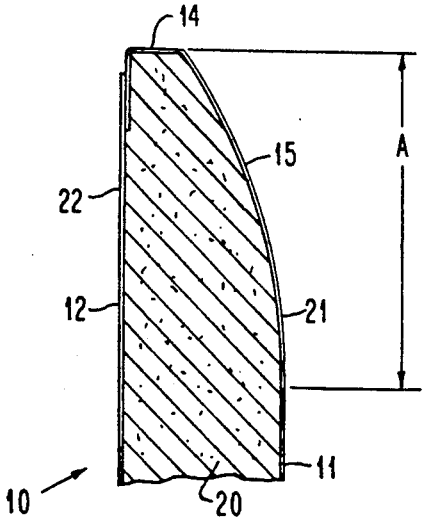
FIG. 3 is an enlarged fragmentary sectional view of a portion of a wallboard of FIG. 1.

As shown in FIG. 3, the connecting surface 15 terminates at the front surface 11 at a distance A in the plane of the front surface 11 of the wallboard 10 from a plane containing the top surface 14. When the distance between the front surface 11 and the rear surface 12 of the wallboard 10 is ½" with the top surface 14 extending for 3/16", the distance A is 1". The distance from a plane containing the bottom surface 16 (see FIG. 1) to the termination of the connecting surface 17 at the front surface 11 in the plane containing the front surface 11 is also the distance A (see FIG. 3). With this relation, the radius of curvature of each of the connecting surfaces 15 and 17 (see FIG. 2) is 1¾".

While the wallboard 10 (see FIG. 1) of the present invention has been shown and described as having a convex curve forming each of the connecting surfaces 15 and 17, it should be understood that it is only necessary for the portion of each of the connecting surfaces 15 and 17 adjacent the front surface 11 of the wallboard 10 to be curved. If the connecting surfaces 15 and 17 were straight adjacent the front surface 11 of the wallboard 10, a visible line under lighted conditions would be produced by compression of the adjacent wallboards 10 due to shrinkage of any of the studs 23 (see FIG. 2) to which the adjacent wallboards 10 are connected or by one of the adjacent wallboards 10 being slightly thicker than the other. The remainder of each of the connecting surfaces 15 and 17 can be straight, if desired. However, it is preferred that each of the connecting surfaces 15 and 17 be a convex curve throughout its length.

While the wallboard joint has been described as being formed between two of the wallboards 10 forming a wall of a room, it should be understood that the same wallboard joint is formed between the wallboards 10 when they form a ceiling. Of course, the wallboards 10 would be attached to horizontally extending ceiling joists.

An advantage of this invention is that there is no ridging. Another advantage of this invention is that the time for erecting a wall or a ceiling is significantly reduced.

For purposes of exemplification, a particular embodiment of the invention has been shown and described according to the best present understanding thereof. However, it will be apparent that changes and modifications in the arrangement and construction of the parts thereof may be resorted to without departing from the spirit and scope of the invention.

We claim:

1. A method of forming a wallboard joint finished without tape between two wallboards including:

forming each of the two wallboards with substantially parallel front and rear surfaces;

forming each of two substantially parallel surfaces of each of the two wallboards substantially perpendicular to the rear surface of the wallboard with each of the two substantially parallel surfaces extending from the rear surface less than one-half of the distance from the rear surface of each of the two wallboards to its front surface;

forming a connecting surface from an end of each of the two substantially parallel surfaces, remote from the rear surface, of each of the two wallboards to the front surface with the connecting surface being curved at least adjacent the front surface of each of the two wallboards;

disposing one of the two substantially parallel surfaces of each of the two wallboards in abutting relation with each other to constitute two abutting surfaces so that the two wallboards are adjacent wallboards having a deep fill recess formed between the connecting surfaces of the adjacent wallboards;

and depositing a sealing compound with a greater compression strength than the compression strength of each of the adjacent wallboards in the deep fill recess formed between the connecting surfaces of the adjacent wallboards so that the sealing compound fills the deep fill recess.

2. The method according to claim 1 including forming each connecting surface of each of the adjacent wallboards as a convex curve for its entire length.

3. The method according to claim 2 including forming each abutting surface of each of the adjacent wallboards substantially perpendicular to the rear surface of the wallboard for about $\frac{3}{8}$ of the distance between the front and rear surfaces of the wallboard.

4. The method according to claim 1 including forming each abutting surface of each of the adjacent wallboards substantially perpendicular to the rear surface of the wallboard for about $\frac{3}{8}$ of the distance between the front and rear surfaces of the wallboard.

5. A wallboard for use in forming a wallboard joint finished without tape including:

a front surface;

a rear surface substantially parallel to said front surface;

a pair of substantially parallel surfaces extending from said rear surface substantially perpendicular thereto for less than one-half of the distance between said front surface and said rear surface;

and a connecting surface extending from the termination of each of said substantially parallel surfaces to said front surface, each of said connecting surfaces being curved convexly at least adjacent its intersection with said front surface.

6. The wallboard according to claim 5 in which each of said connecting surfaces has a convex curve for its entire length from the termination of one of said substantially parallel surfaces to said front surface.

7. The wallboard according to claim 6 in which each of said substantially parallel surfaces extends from said rear surface substantially perpendicular thereto for about $\frac{3}{8}$ of the distance between said front surface and said rear surface.

8. The wallboard according to claim 7 in which each of said connecting surfaces intersects with said front surface at a distance from a plane containing said substantially parallel surface from which said connecting surface extends with the distance being greater than twice the length of said substantially parallel surface.

9. The wallboard according to claim 5 in which each of said substantially parallel surfaces extends from said rear surface substantially perpendicular thereto for about $\frac{3}{8}$ of the distance between said front surface and said rear surface.

10. The wallboard according to claim 5 in which each of said connecting surfaces intersects with said front surface at a distance from a plane containing said substantially parallel surface from which said connecting surface extends with the distance being greater than twice the length of said substantially parallel surface.

11. A wallboard joint formed without tape including:

a pair of adjacent wallboards;

each of said adjacent wallboards including:

a front surface;

a rear surface substantially parallel to said front surface;

a pair of substantially parallel surfaces extending from said rear surface substantially perpendicular thereto for less than one-half of the distance between said front surface and said rear surface;

and a connecting surface extending from the termination of each of said substantially parallel surfaces to said front surface, each of said connecting surfaces being curved convexly at least adjacent the intersection with said front surface;

one of said pair of substantially parallel surfaces of one of said adjacent wallboards abutting one of said pair of substantially parallel surfaces of the other of said adjacent wallboards;

one of said connecting surfaces of each of said adjacent wallboards cooperating to form a deep fill recess therebetween;

and a sealing compound filling said deep fill recess, said sealing compound having a greater compression strength than the compression strength of each of said adjacent wallboards.

12. The wallboard joint according to claim 11 in which each of said connecting surfaces of each of said adjacent wallboards has a convex curve for its entire length from the termination of one of said substantially parallel surfaces to said front surface.

13. The wallboard joint according to claim 12 in which each of said substantially parallel surfaces of each of said adjacent wallboards extends from said rear surface substantially perpendicular thereto for about $\frac{3}{8}$ of the distance between said front surface and said rear surface.

14. The wallboard joint according to claim 13 in which each of said connecting surfaces of each of said adjacent wallboards intersects with said front surface at a distance from a plane containing said substantially parallel surface from which said connecting surface extends with the distance being greater than twice the length of said substantially parallel surface.

15. The wallboard joint according to claim 13 including a very thin coating of a joint compound overlying said sealing compound.

16. The wallboard joint according to claim 12 including a very thin coating of a joint compound overlying said sealing compound.

17. The wallboard joint according to claim 11 in which each of said substantially parallel surfaces of each of said adjacent wallboards extends from said rear surface substantially perpendicular thereto for about $\frac{3}{8}$ of the distance between said front surface and said rear surface.

18. The wallboard joint according to claim 17 including a very thin coating of a joint compound overlying said sealing compound.

19. The wallboard joint according to claim 11 in which each of said connecting surfaces of each of said adjacent wallboards intersects with said front surface at a distance from a plane containing said substantially parallel surface from which said connecting surface extends with the distance being greater than twice the length of said substantially parallel surface.

20. The wallboard joint according to claim 11 in which said sealing compound includes a mixture of chopped fiberglass and a fast setting cement.

21. The wallboard joint according to claim 11 in which said sealing compound includes a mixture of filament fibers and a fast setting cement.

22. The wallboard joint according to claim 11 in which said wallboard joint is finished without tape.

* * * * *

UNITED STATES PATENT AND TRADEMARK OFFICE

CERTIFICATE OF CORRECTION

PATENT NO. : 5,230,200

DATED : July 27, 1993

INVENTOR(S) : Waymon J. Douglas et al

It is certified that error appears in the above-identified patent and that said Letters Patent is hereby corrected as shown below:

Column 3, line 9, "Shull." should read --- Shull, ---.

Column 3, line 37, "joints" should read --- joists ---.

Column 3, line 60, "joints" should read --- joists ---.

Column 3, line 65, "an" should read --- and--- .

Column 7, line 30, cancel the period (.) and substitute a --- comma (,)--- .

Signed and Sealed this

Twenty-second Day of March, 1994

Bruce Lehman

BRUCE LEHMAN

*Commissioner of Patents and Trademarks*

*Attest:*

*Attesting Officer*